US012616910B2

(12) United States Patent
Christensen et al.

(10) Patent No.: US 12,616,910 B2
(45) Date of Patent: May 5, 2026

(54) MODEL VEHICLE SEALED DRIVELINE

(71) Applicant: TRAXXAS, L.P., McKinney, TX (US)

(72) Inventors: Casey Christen Jens Christensen, McKinney, TX (US); Otto Karl Allmendinger, Rowlett, TX (US); Jory Sprowl, Howe, TX (US); Skylar Hagler, Anna, TX (US); Adam Cole Ewing, McKinney, TX (US)

(73) Assignee: TRAXXAS, L.P., McKinney, TX (US)

( * ) Notice: Subject to any disclaimer, the term of this patent is extended or adjusted under 35 U.S.C. 154(b) by 77 days.

(21) Appl. No.: 18/377,410

(22) Filed: Oct. 6, 2023

(65) Prior Publication Data

US 2024/0207749 A1 Jun. 27, 2024

Related U.S. Application Data

(60) Provisional application No. 63/414,088, filed on Oct. 7, 2022.

(51) Int. Cl.
*A63H 17/26* (2006.01)
*A63H 29/22* (2006.01)

(52) U.S. Cl.
CPC ..... *A63H 17/262* (2013.01); *A63H 29/22* (2013.01)

(58) Field of Classification Search
CPC ..... A63H 17/262; A63H 29/22
See application file for complete search history.

(56) References Cited

U.S. PATENT DOCUMENTS 4,329,886 A * 5/1982 Branstner ..... A63H 31/02 74/416
2006/0226621 A1* 10/2006 Byers ..... A63H 17/26 280/86.757
2006/0260863 A1* 11/2006 Byers ..... B60G 3/20 180/385

* cited by examiner

*Primary Examiner* — Thomas M Sember
(74) *Attorney, Agent, or Firm* — Daryl R. Wright; Greg Carr

(57) ABSTRACT

A model vehicle comprising an enclosed driveline is provided. The enclosed driveline may include a propulsion section, a power delivery section, a transmission section, a differential section, and in some cases, a second differential section. Failure of any component within any one of the various sections is inhibited or prevented from traveling from one section to another. Each section includes a first access and a second access in which power is input through the first access and output through the second access. In the propulsion section for example, there is a propulsion housing with a first propulsion access and a second propulsion access in which a motor drive input enters in through the first propulsion access and the motor drive output exits via the second propulsion access. The spur and pinion gears couple the motor drive input to the motor drive output within the propulsion housing.

10 Claims, 6 Drawing Sheets

MODEL VEHICLE SEALED DRIVELINE

RELATED APPLICATIONS

This application (claims the benefit of a related U.S. Provisional Application Ser. No. 63/414,088 filed Oct. 7, 2022, entitled "MODEL VEHICLE SEALED DRIVELINE," to Casey Christen Jens Christensen et al., the disclosure of which is incorporated by reference herein in its entirety.

BACKGROUND

The following descriptions and examples are not admitted to be prior art by virtue of their inclusion in this section.

Radio Controlled (RC) model vehicles have a long history as an enjoyable hobby for people of all ages. Over the years, the RC industry has grown and branched off into many sizeable sub-segments, one of which is off-road racing. Off-road racing has various classes, leagues, and vehicle types for people to experience the thrills of off-road racing in a smaller, sometimes scale versions of full-size vehicles. The intensity and competitiveness of racing has led to full-time four-wheel drive, full electric vs. nitro combustion engine, and innovative use of materials and designs to improve reliability, cost, and lightness.

During extreme racing situations and conditions, components can sometimes break in a primary failure. In some cases, the fracturing of gears and metal in a transmission (for example) have resulted in damage to other components along a driveline. Minimizing potential secondary damage caused by a primary fracture helps in quickly repairing and re-fielding an off-road RC model vehicle after a primary failure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with one embodiment, a model vehicle comprising an enclosed driveline is provided. The enclosed driveline comprises a propulsion section including a propulsion housing having a first propulsion access and a second propulsion access. The model vehicle further has a motor drive input associated with the first propulsion access and a motor drive output associated with the second propulsion access. Wherein the motor drive input is coupled to the motor drive output within the propulsion housing.

The model vehicle further comprises a power delivery section, further comprising a power delivery housing having a first power delivery access and a second power delivery access. The power delivery section also comprises a driveshaft passing through the first power delivery access and the second power delivery access and a first washer and a second washer. The first washer is provided in a first washer holder and inhibits contaminants from passing through the first propulsion access while the second washer is provided in a second washer holder and inhibits contaminates from passing through the second propulsion access. Wherein the power delivery housing encloses the driveshaft, the motor drive output is coupled of one end of the driveshaft and wherein failure in one section is inhibited from passing through to another section.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows:

FIG. 6A shows the power delivery section 400 with the power delivery housing 410 cover removed, FIG. 6B shows the power delivery section 400 of FIG. 6A with the driveshaft 440 removed. according to an embodiment of the present disclosure.

DETAILED DESCRIPTION

In the following specification, numerous specific details are set forth to provide a thorough understanding of embodiments of the present disclosure. However, those skilled in the art will appreciate that the embodiments may be practiced without such specific details. In other instances, well-known elements have been illustrated in schematic or block diagram form in order not to obscure embodiments of the present disclosure in unnecessary detail.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

Figure 1:
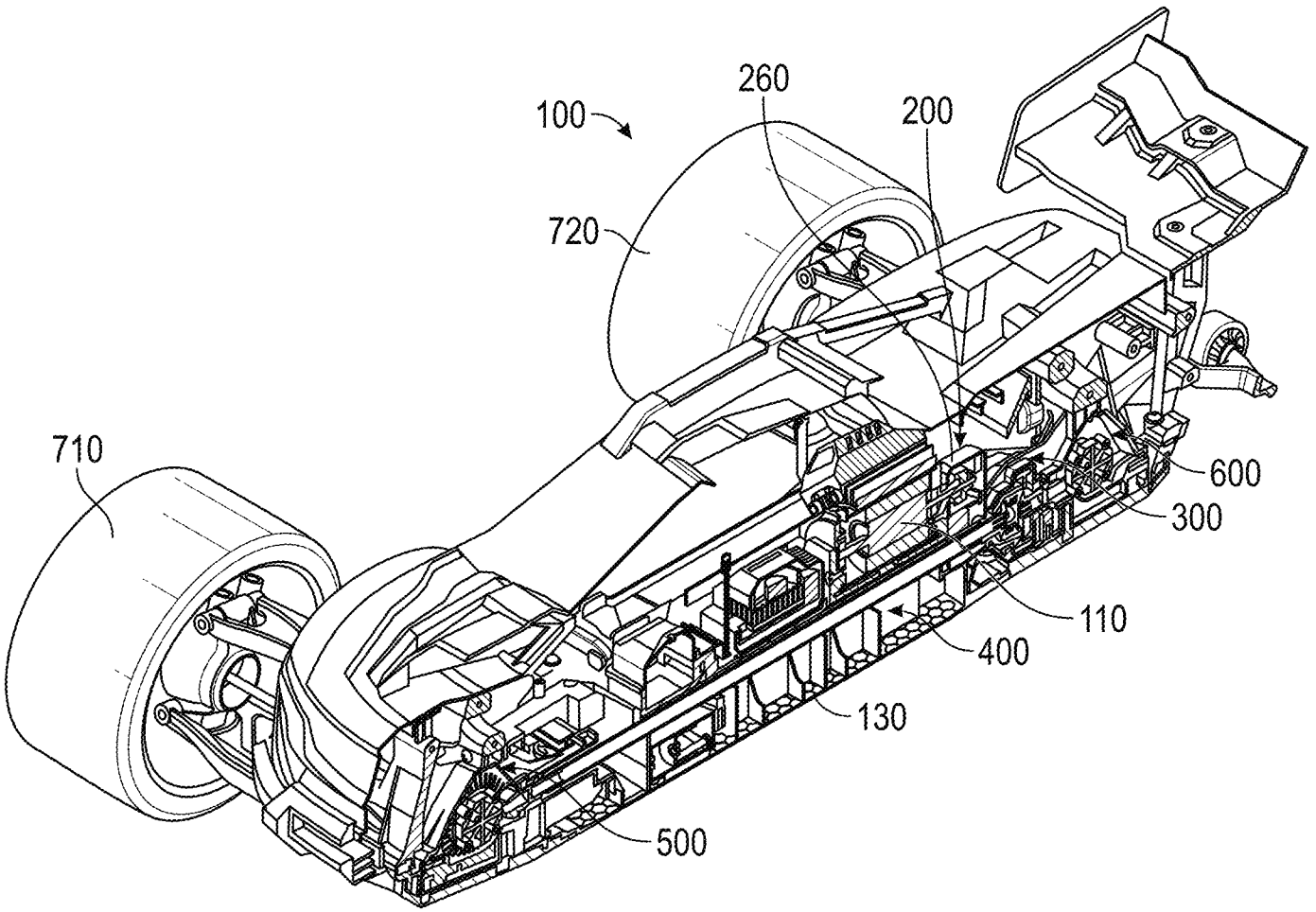
FIG. 1 is an upper, left, front perspective view of a cross-section of one half of a model vehicle, according to an embodiment of the present disclosure.
Figure 2:
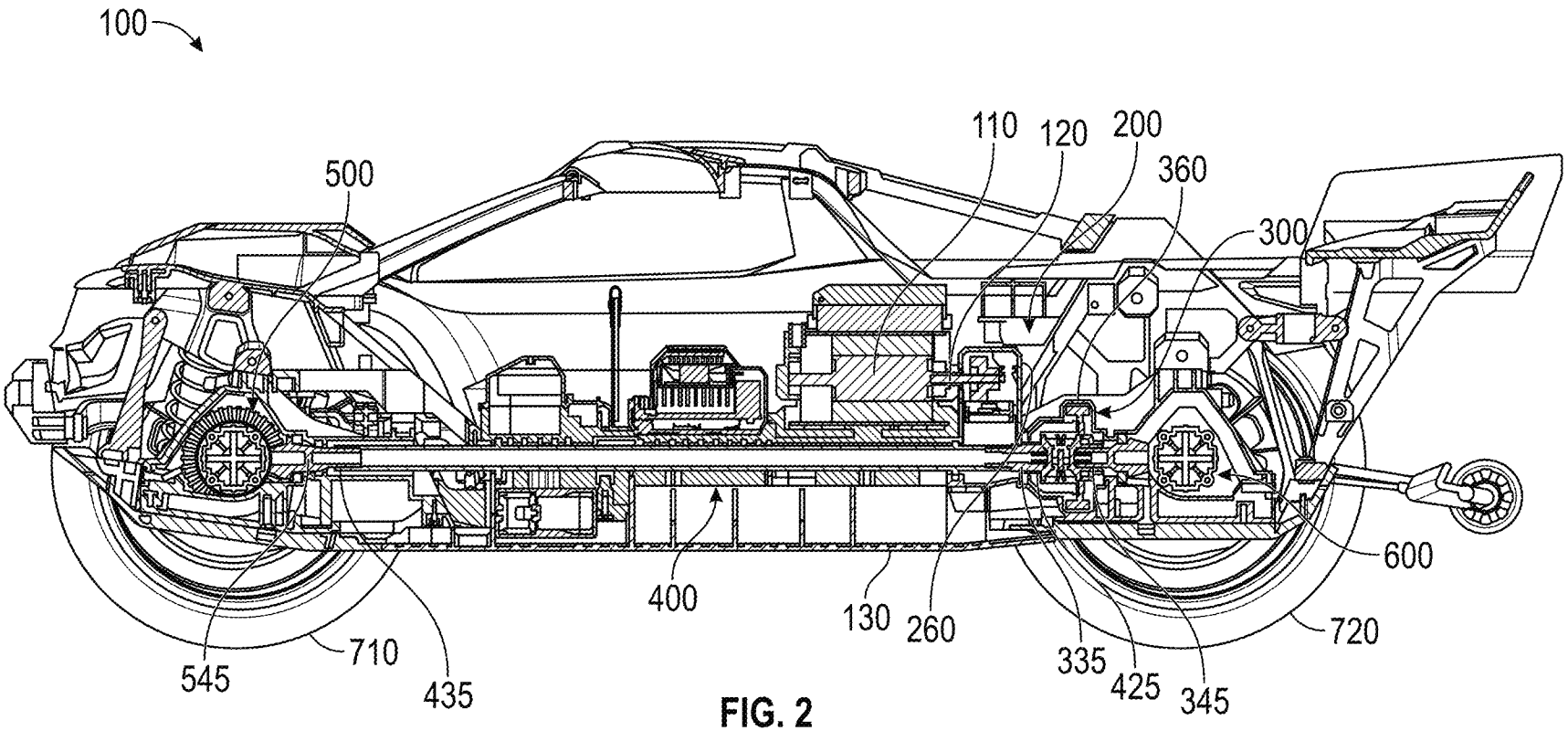
FIG. 2 is a left-side elevation view taken along the section of the perspective view of FIG. 1, according to an embodiment of the present disclosure.

In an exemplary embodiment referring generally to FIGS. 1 and 2, a radio controlled or remote controlled (RC) model vehicle comprising an enclosed driveline system 100 is shown in a cross-sectional view along the longitudinal centerline of the model vehicle. Model vehicle 100 comprises a propulsion section 200, a transmission section 300, a power delivery section 400, a first differential section 500, and a second differential section 600. Each of the various sections are enclosed to restrict or inhibit any failed component, debris or contaminates, from entering or exiting the various sections along the driveline causing secondary failure, premature wear, and/or noise and other possible long-term damage.

Each of the various sections may comprise a housing. In some cases, the various sections will share a wall, and an output from one section will lead directly into an input into another section. The outputs and inputs are usually shielded by close tolerances to the mechanism passing through, bearings, or washers, among other techniques. The barriers do not need to be waterproof, but use of an embodiment of an enclosed driveline may render the system significantly water resistant.

Figure 3B:
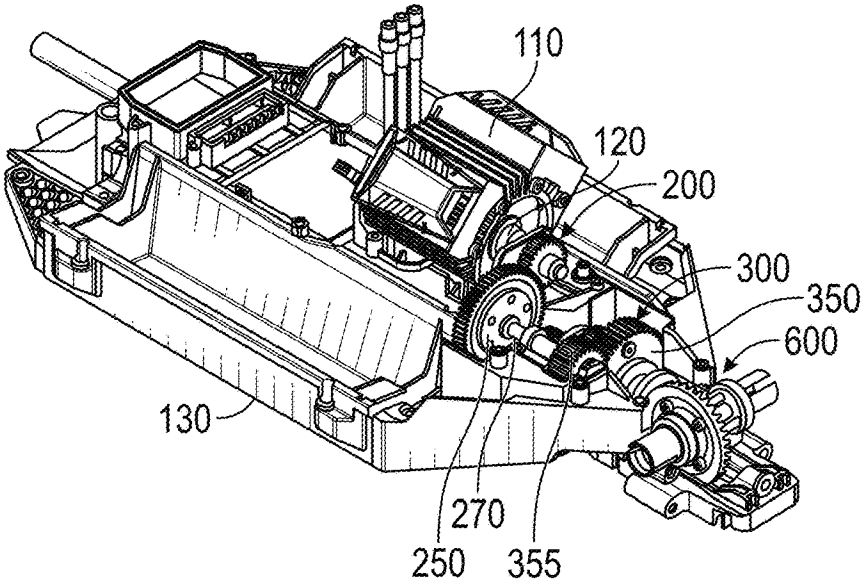
FIG. 3A, 3B are an upper, left, rear perspective view of some of the components from FIG. 1 showing the housing covers on (FIG. 3A), and the housing covers off (FIG. 3B), according to an embodiment of the present disclosure.
Figure 3A:
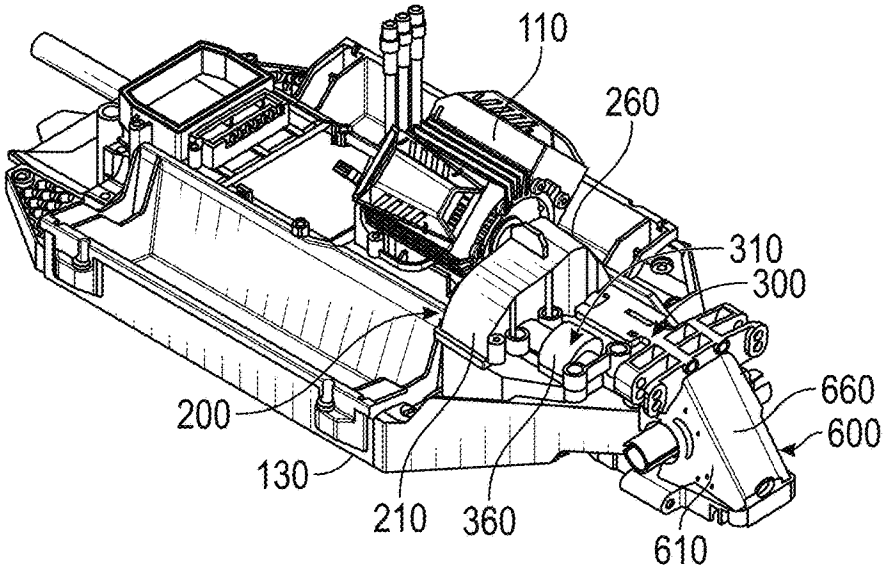

Turning now to FIGS. 3A and 3B. FIG. 3A shows a chassis 130 comprising a motor 100, the removable propulsion housing top 260 for the propulsion section 200, the removable transmission top 360 for the transmission section 300, and the removable second differential top 660 for the second differential section 600. The individual housings shown in these figures are the propulsion housing 210, the transmission housing 310, and the second differential housing 610. FIG. 3B shows the same components in FIG. 3A but without the removable propulsion housing top 260, the removable transmission top 360, and the removable second differential top 660. In this view, the mechanical components of the driveline are visible, taking the rotation of the electric motor 100 and transmitting a rotating output to the wheels (not shown in this figure) via the differential.

Figure 4:
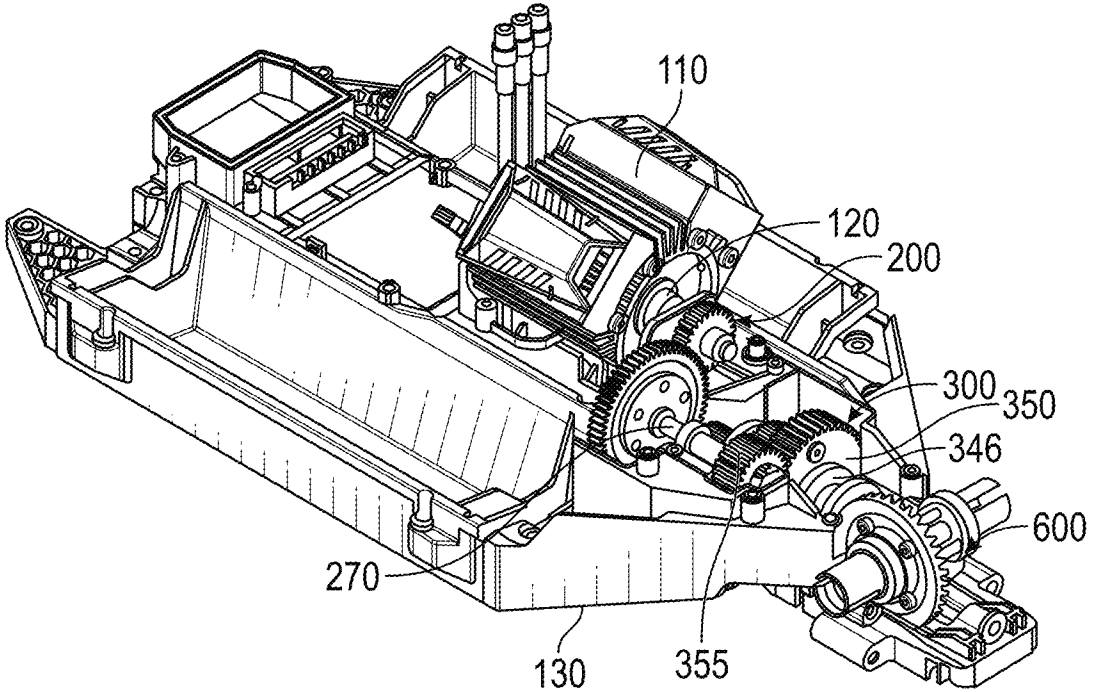
FIG. 4 is an upper, left, rear perspective view of FIG. 3A shown in a slightly larger format, according to an embodiment of the present disclosure.
Figure 5:
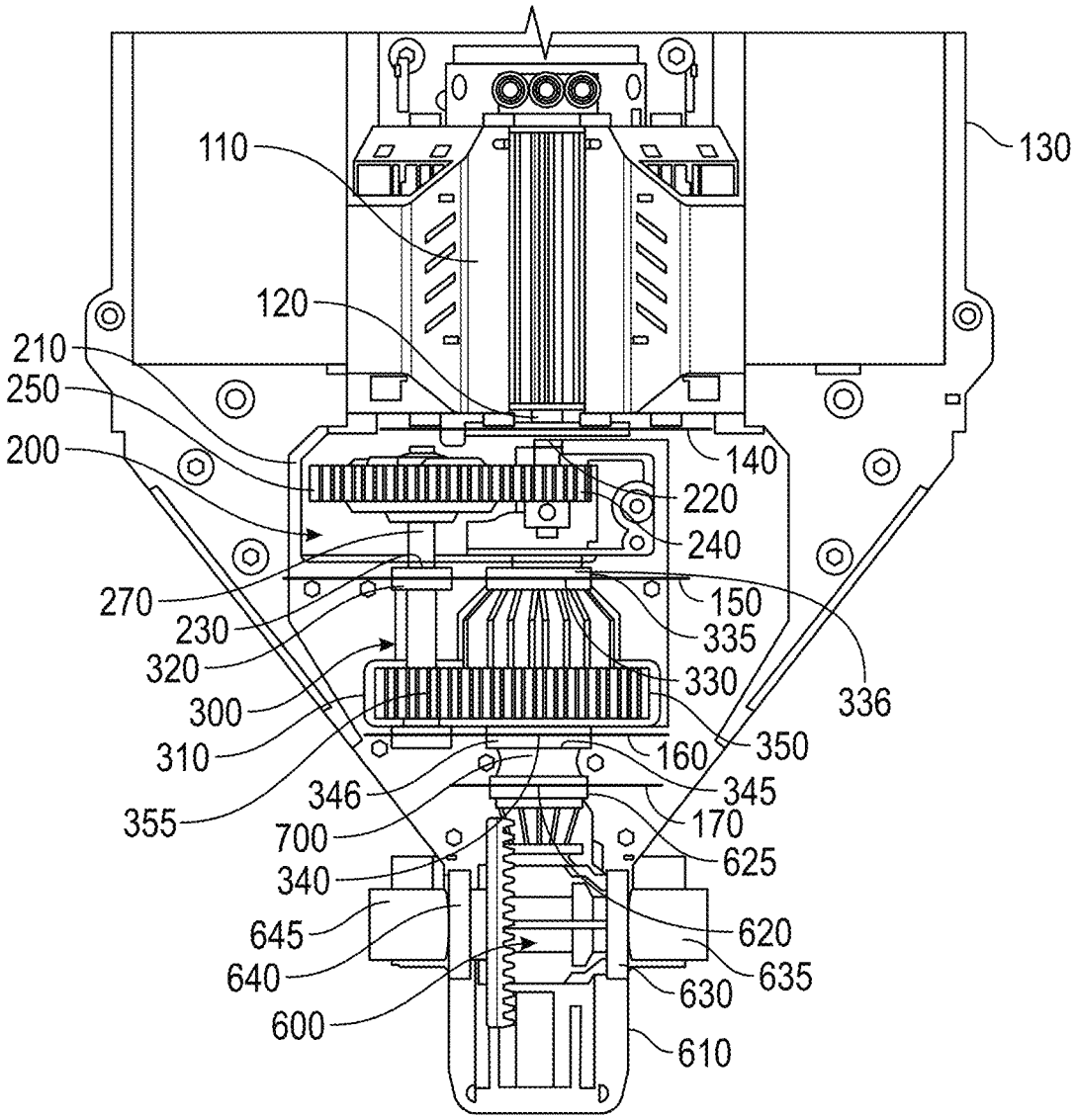
FIG. 5 is an enlarged portion of FIG. 4 shown from an upper elevated view, according to an embodiment of the present disclosure.

FIGS. 4 and 5 show an enlarged portion of the chassis and components from FIG. 3B. FIG. 4 shows an upper, left, rear perspective view and FIG. 5 shows an upper elevated view of a portion of the chassis 130 shown in FIG. 4. FIGS. 4 and 5 show more clearly the drivetrain components and gearing used to transmit the motor input 120 into the propulsion section 200, to the transmission section 300, and onward to the second differential section 600.

Looking at FIG. 5, the motor 110 is shown at the front of the model vehicle and positioned in a portion of the chassis 130. The motor input 120 is shown exiting (the bottom in this view) of the motor 110, passing through the first propulsion access 220 provided in the propulsion housing 210, and powering a ratioed output 270 that exits through the second propulsion access 230. While within the propulsion section 200, the motor input 120 powers the pinion gear 240 that provides a ratioed output 270 via the spur gear 250 exiting from the second propulsion access 230.

The ratioed output 270 from the propulsion section 200 exits the second propulsion access 230 and enters into the first transmission access 320 provided in the transmission housing 310. As shown in the view in FIG. 5, the ratioed output 270 drives the main transmission gear 350 via transmission pinion gear 355 and powers transmission outputs 335 and 345, exiting from a second transmission access 330 and a third transmission access 340 (if the model vehicle 100 is four-wheel drive). If the model vehicle is only two-wheel drive, then only one transmission output 335 or 345 is needed and one of the second transmission access 330 or the third transmission access 340 is not needed. The transmission outputs 335 and 345 are then directed to a corresponding first driveshaft 440 (not shown in this figure, see FIGS. 6A and 6B) and a second driveshaft 700. The transmission outputs 335 and 345 are respectively shielded via bearings 336 and 346 (see FIGS. 4 and 5), for example.

The second driveshaft 700 transmits the transmission output 345 to the second differential input 625 via the second differential input access 620 provided in the second differential housing 610. The second differential 600 then provides second differential outputs 635 and 645 for the wheels (see FIGS. 1 and 2) via the second differential first output access 630 and the second differential second output access 640. In this exemplary embodiment, most, if not all of the various accesses the respective housings shown in FIG. 5 are shielded via bearings acting as barriers at the access locations. The bearings (e.g., 336, 346) help to substantially seal the respective housing enclosures and restrict or inhibit the movement of broken components from one section to another section.

The heavier dark lines are used to indicate the barriers 140, 150, 160, and 170 formed by the housings. In this view, there is a first barrier 140 between the motor 110 and the propulsion section 200, a second barrier 150 between the propulsion section 200 and the transmission section 300, a fourth barrier 160 between the transmission section 300 and one end of the second driveshaft 700, and a fifth barrier 170 between the other end of the second driveshaft and the second differential 600.

This FIG. shows a motor 110 ultimately providing a power input 120 to the rear wheels 720 (see FIGS. 1 and 2 for and exemplary one of the pair of rear wheels) via the second differential power outputs 635 and 645 using the corresponding second differential access 630 and the third differential access 640. This exemplary embodiment is a four-wheel drive embodiment. The current route powers the rear wheels 720. The transmission section 300 also provides rotative power to the front wheels 710 (see FIGS. 1 and 2 for and exemplary one of the pair of front wheels) via the second transmission access 330, the power delivery section 400, the first driveshaft 440 (see FIGS. 6A and 6B), and the first differential section 500 (see FIGS. 1 and 2).

Figure 6B:
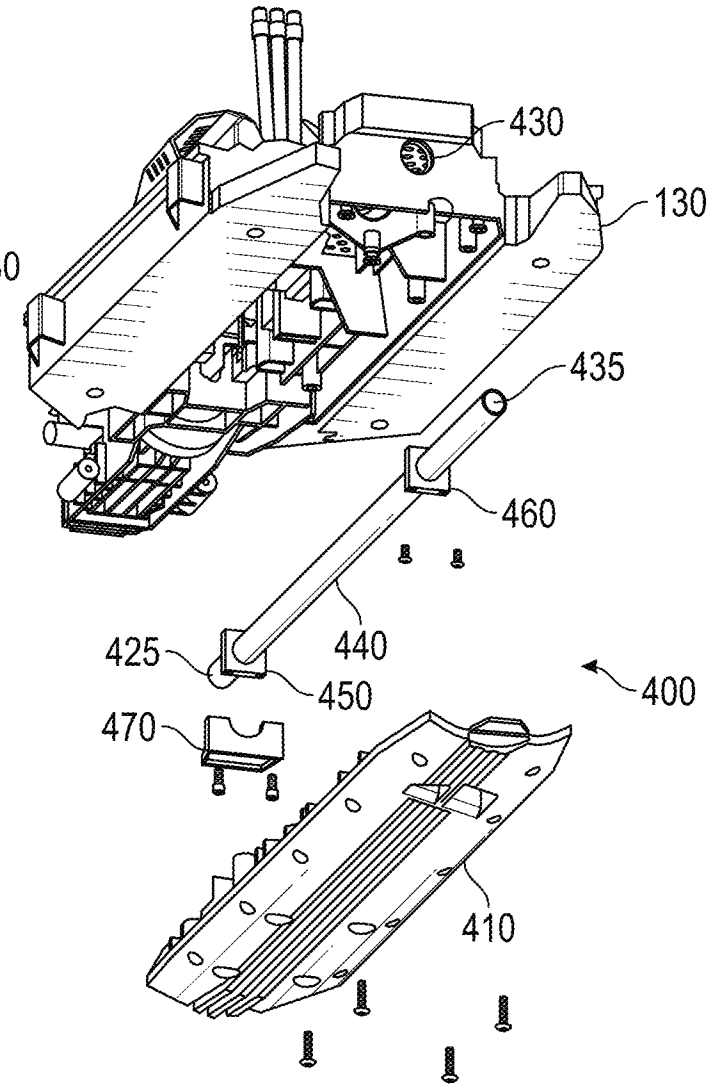
FIGS. 6A and 6B are lower, right-side, front perspective views of the bottom of the model vehicle of FIG. 1.
Figure 6A:
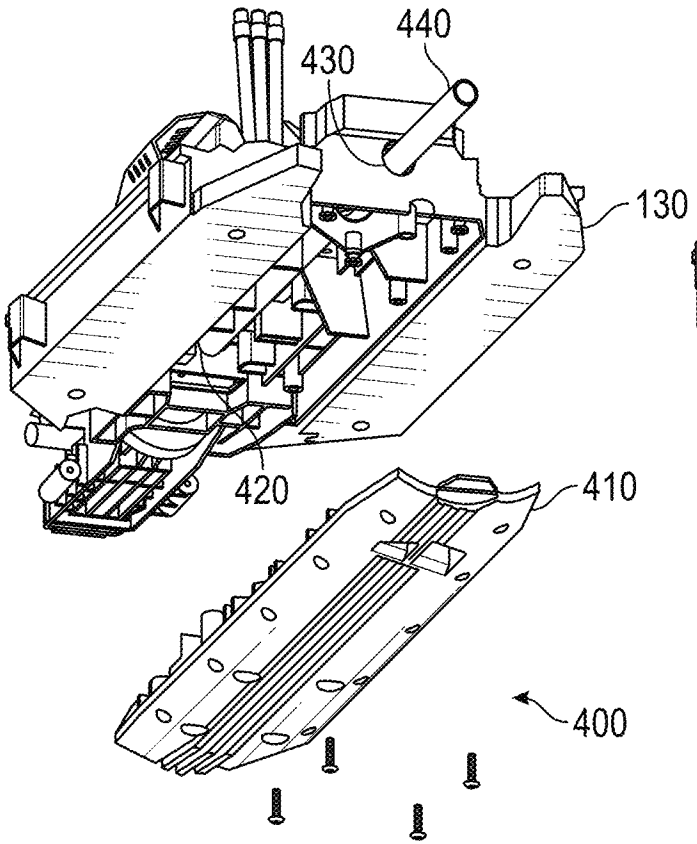

FIGS. 6A and 6B shown the bottom of the model vehicle chassis 130 comprising the power delivery section 400 according to an embodiment of the current disclosure. As seen in FIG. 6A, the power delivery section 400 comprises a power delivery housing 410, made of the cover and the bottom of the chassis 130 forming an enclosure. The power delivery housing 410 has a first power delivery access 420 for a first power delivery input 425, and a second power delivery access 430 for a second power delivery output 435. The first power delivery input 425 receives the transmission output 335 via the second transmission access 330 and the first power delivery access 420. The first power delivery input 425 is coupled to the second power delivery output 435 via the driveshaft 440. The power delivery output 435 at the other end of the driveshaft 440 exits the power delivery housing 410 via the second power delivery access 430.

In FIG. 6B, the driveshaft 440 is removed from the interior of the power delivery housing 410. In this view it is easier to see the first washer 450, the second washer 460, and a washer holder 470 in an exploded view. The first washer 450 and the second washer may be felt, rubber, plastic, or other material appropriate for a particular application. The first washer 450 and the second washer 460 are used to shield or otherwise block entry into the power delivery section 400. As a result, dirt, water, broken components or other debris may be inhibited or restricted from entering the interior of the power delivery housing 410 and cause damage or excessive wear to the driveshaft 440.

Referring back to FIGS. 1 and 2, first differential section 500 is the same as the second differential section 600 except for orientation. Therefore, there is no need to go into detail regarding the first differential housing, first differential first access, first differential second access, and first differential third access. The first differential section 500 is for providing rotative transmission output to the front wheels.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features.

It is the express intention of the applicant not to invoke 35 U.S.C. § 112, paragraph 6 for any limitations of any of the claims herein, except for those in which the claim expressly uses the words 'means for' together with an associated function.

We claim:

1. A model vehicle comprising an enclosed driveline further comprising:
- a propulsion section, further comprising;
  - a propulsion housing, further comprising;
    - a first propulsion access; and
    - a second propulsion access;
  - a motor drive input associated with the first propulsion access;
  - a ratioed output associated with the second propulsion access;
  - wherein the motor drive input is coupled to the ratioed output within the propulsion housing;
- a power delivery section, further comprising;
  - a power delivery housing, further comprising;
    - a first power delivery access; and
    - a second power delivery access;
  - a driveshaft passing through the first power delivery access and the second power delivery access;
  - a first washer provided in a first washer holder and inhibiting contaminates from passing through the first propulsion access; and
  - a second washer provided in a second washer holder and inhibiting contaminates from passing through the second propulsion access;
  - wherein the power delivery housing encloses the driveshaft; and
- wherein the ratioed output is mechanically coupled to one end of the driveshaft.

2. The model vehicle according to claim 1 further comprising:
- a transmission section further comprising:
  - a transmission housing, further comprising:
    - a first transmission access; and
    - a second transmission access;
  - a transmission input associated with the first transmission access;
  - a transmission output associated with the second transmission access;
- two or more transmission gears;
  - wherein the transmission housing encloses the two or more transmission gears;
- wherein the ratioed output is mechanically coupled to the one end of the driveshaft via the ratioed output coupling with the transmission input and the transmission output coupling with the one end of the driveshaft.

3. The model vehicle according to claim 2, further comprising:
- a third transmission access provided in the transmission housing and associated with a second transmission output;
- a second driveshaft;
- a second differential section, further comprising:
  - a second differential section housing, further comprising:
    - a second differential input access; and
    - a second differential output access,
    - a second differential, further comprising:
      - a second differential input associated with the second differential input access;
      - a second differential power output coupled to the second differential output access;
  - wherein the second differential power output is rotatively coupled with a second model vehicle wheel;
- wherein one end of the second driveshaft is coupled with the second transmission output; and
- wherein an other end of the second driveshaft is couple with the second differential input.

4. The model vehicle according to claim 2 wherein the transmission housing further comprises a removable cover enabling access to an interior of the transmission housing.

5. The model vehicle according to claim 2 wherein at least one of the first transmission access or the second transmission access is provided via a bearing.

6. The model vehicle according to claim 1 further comprising:
- a differential section, further comprising;
  - a differential housing, further comprising:
    - a differential input access; and
    - a differential output access;
    - a differential, further comprising:
      - a differential input associated with the differential input access;
      - a differential power output coupled to a model vehicle wheel; and
- wherein an other end of the driveshaft is coupled with the differential input.

7. The model vehicle according to claim 1 where the first washer and the second washer are felt washers.

8. The model vehicle according to claim 1 wherein the motor drive input is coupled to the ratioed output via a pinion gear coupled with a spur gear.

9. The model vehicle according to claim 1, further comprising:
- a model vehicle chassis;
- wherein the propulsion housing is partially formed by a portion of a model vehicle chassis.

10. The model vehicle according to claim 1, wherein the first and second washer inhibits contaminates from passing into or out of the power delivery section.

* * * * *